United States Patent [19]

Evans

[11] 4,185,370

[45] Jan. 29, 1980

[54] METHOD OF MAKING A WHEEL RIM

[75] Inventor: James L. Evans, Ypsilanti, Mich.

[73] Assignee: Kelsey Hayes Co., Romulus, Mich.

[21] Appl. No.: 876,773

[22] Filed: Feb. 10, 1978

[51] Int. Cl.[2] ..... B21H 1/10; B21K 1/38; B21D 53/30

[52] U.S. Cl. ..... 29/159.1; 29/159 R

[58] Field of Search ..... 29/159.1, 159 R; 72/105; 113/116 D

[56] References Cited

U.S. PATENT DOCUMENTS

| | | | |
|---|---|---|---|
| 2,181,848 | 11/1939 | Le Jeune et al. | 29/159.1 |
| 2,185,347 | 1/1940 | Le Jeune | 29/159.1 |
| 3,364,550 | 1/1968 | Jessee et al. | 29/159.1 |
| 3,575,035 | 4/1971 | Nokes | 29/159.1 X |

OTHER PUBLICATIONS

Metal Handbook by American Society for Metals; (1948), p. 771.

*Primary Examiner*—Francis S. Husar
*Assistant Examiner*—D. M. Gurley
*Attorney, Agent, or Firm*—Ralph J. Skinkiss

[57] ABSTRACT

An improved method of making vehicle wheel rims particularly suitable for use with materials having relatively low ductility, such as aluminum, is disclosed. A circumferential drop center well is formed about the periphery of the band and work hardened so that the well material exhibits higher strength and lower ductility than the remaining band material. The strength and ductility differential between the well and band material adjacent thereto assists in confining material movement in subsequent rim forming operations and induces drawing of the rim bead seat area material.

8 Claims, 7 Drawing Figures

METHOD OF MAKING A WHEEL RIM

BACKGROUND OF THE INVENTION

My invention relates to a method of manufacturing vehicle wheel rims from materials characterized by having a relatively low ductility such as aluminum, or high strength, low alloy (HSLA) steel. By my method, wheel rims of aluminum or HSLA steel may be manufactured using conventional mass production rim rolling apparatus presently used in the manufacture of SAE 1010 steel rims. Prior art roll forming techniques for forming wheel rims from sheet material have proven unsuccessful when applied to aluminum materials. Because of aluminum's lower ductility, sheet aluminum when roll formed on conventional rim rolling equipment resists the necessary stretching especially at the butt weld, to form an acceptable wheel rim section.

In the manufacture of steel wheel rims a strip of rolled sheet steel is coiled and butt welded to form a cylindrical hoop or band. After deburring the butt weld, the cylindrical band is first placed in a press wherein the lateral edges of the band are flared radially outward. Flaring of the edges serves to preform the rim flange area and provide a band cross-sectional profile suitable for retention on roll forming equipment used for subsequent forming operations. After flaring of the lateral edges the band is subjected to a series of roll forming operations whereby the band is progressively formed into the final desired cross-sectional profile and circumference. During roll forming and sizing operations, the band circumference expectantly increases. Thus the initial dimensions of the strip from which the band is formed are selected to accommodate such material elongation.

While the above described process has proven successful in the manufacture of SAE 1010 steel wheel rims it has not heretofore been successful for the manufacture of wheel rims from materials having a ductility significantly lower than that of SAE 1010 steel. Thus the prior art has been unsuccessful in roll forming aluminum sheet material into acceptable wheel rims. Because of aluminum's lower ductility bands of aluminum, having the dimensions as heretofore used in forming steel rims of a given wheel size, have not met the efficiency standards required for mass production. Because of aluminum's resistance to stretching (low ductility) the band lateral edges may not be flared to the same extent that a steel band is flared, without fracturing the butt weld. Increasing the band circumference to reduce the stress at the weld results in an oversize rim because of band growth during the roll forming operations.

Because of the aforementioned problems aluminum wheels heretofore have been produced by casting or forging techniques. However, cast or forged aluminum wheels are costly to manufacture and, because of the lower properties of cast aluminum or the processing requirement of forged aluminum, the wheels have such mass that no significant weight savings is realized. Therefore, it is preferable to use mill rolled aluminium sheet to take full advantage of the materials high strength, lower processing costs, and overall lower weight.

SUMMARY OF THE INVENTION

By my new method, wheel rims may be roll formed from any sheet material having a relatively low ductility, particularly aluminum, using conventional rim rolling equipment.

In the manufacture of a wheel rim by roll forming, a strip of sheet material is first formed into a hoop, by coiling and butt welding the ends thereof. The hoop or band is then placed in a press to flare the lateral edges radially outward preforming the rim flanges and providing a band cross-section suitable for positioning on the roll forming machine. Because of aluminum's low ductility it is difficult to flare the band edges to the same extent as that in forming a steel rim, without overstressing the butt weld. Therefore, it is necessary to form the initial band such that its circumference more closely approximates that of the finished rim than is customary in the manufacture of steel rims.

The first roll forming operation comprises rolling the drop center form well into the flared band. Because of the generally larger band diameter the well must be rolled deeper than customary for the smaller diameter steel band. Having rolled the well into the band, the material in the well area is further work or strain hardened by a coining or metal squeezing process whereby the well material is rolled between a pair of opposing matched roll dies such that the well material is compressed between the roll dies filling the gap therebetween. Strengthening of the well area material through work hardening is most critical to the success of the subsequent roll forming operations.

In the second roll forming operation, roll pressure is applied radially inward on the tire seat areas and radially outward on the work hardened well. The tire seat areas being weaker than the deep work hardened well are caused to shrink while the deep well circumference is increased.

During the third rolling operation, the rim section is completed to profile by curling the flanges, flattening the outboard hump and sizing the rim diametrically for the final sizing operations using an expanding press and a shrinking operation known as a "True-Centric" for dimensional control.

BRIEF DESCRIPTION OF THE DRAWINGS

FIG. 4 shows the initial forming step.

FIG. 5 shows the configuration of the rim at the end of the first roll forming operation.

FIG. 6 shows the configuration of the rim at the end of the second roll forming operation.

FIG. 7 shows the configuration at the end of the third roll forming operation.

DETAILED DESCRIPTION OF THE INVENTION

Although the following description of my invention refers specifically to aluminum, it is to be understood that my new method of roll forming a wheel rim may be equally applied to any suitable material exhibiting low ductility, for example high strength low alloy (HSLA) steels and other mild materials such as SAE 1010 mild steel.

Figure 1:
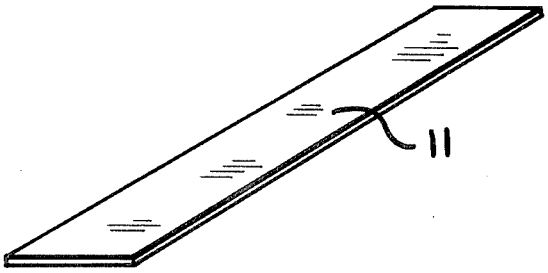
FIG. 1 is a perspective view showing a strip of sheet stock used to form a wheel rim in accordance with the method of this invention.

Referring now to the figures. FIG. 1 illustrates an elongated strip 11 of aluminum sheet material suitable for forming into a wheel rim in accord with the principles of my invention. Because of the significantly lower ductility of aluminum over steel, I have found it desirable to increase the strip length and correspondingly decrease the strip width over that commonly used for manufacturing a steel rim. For example in producing a typical 15 inch by 6 inch wheel rim from aluminum I have found it preferable to increase the strip length by approximately 5.8% over that suitable for steel and decrease the strip width by approximately 4%.

Figure 2:
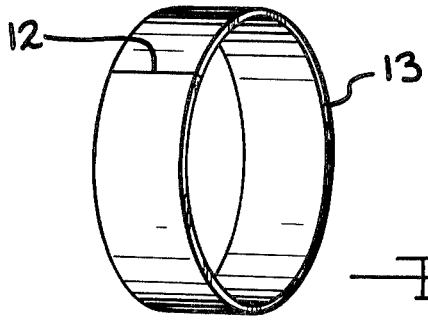
FIG. 2 is a perspective view showing the strip of stock as shown in FIG. 1 formed into a hoop.
Figure 3:
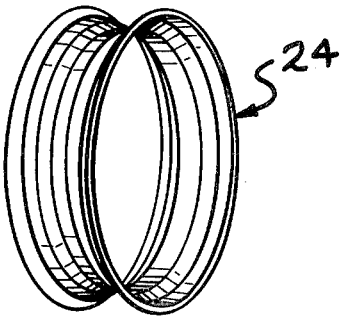
FIG. 3 is a perspective view showing the wheel rim in its final configuration.
Figure 4:
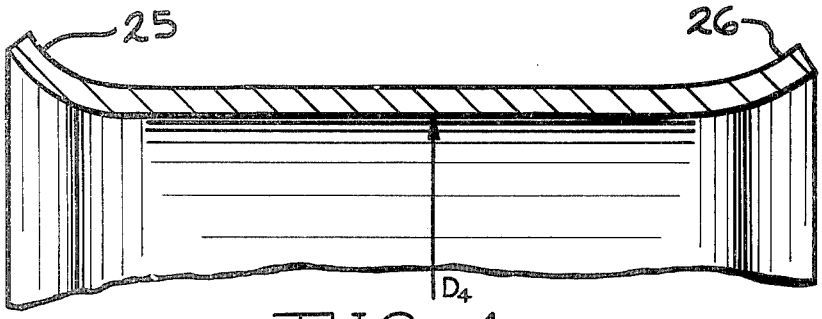
FIGS. 4 through 7 are cross-sectional views showing the steps in the forming operation.
Figure 5:
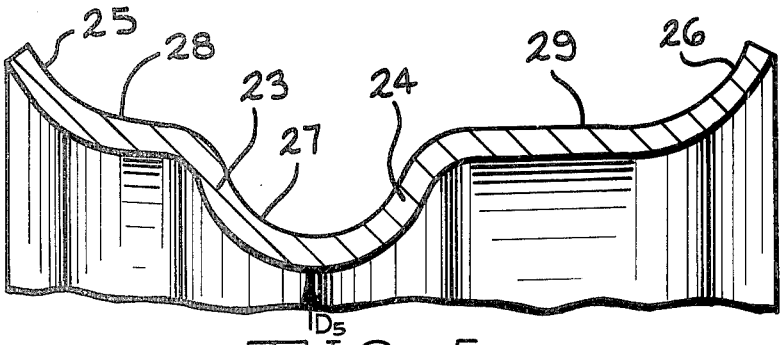
Figure 6:
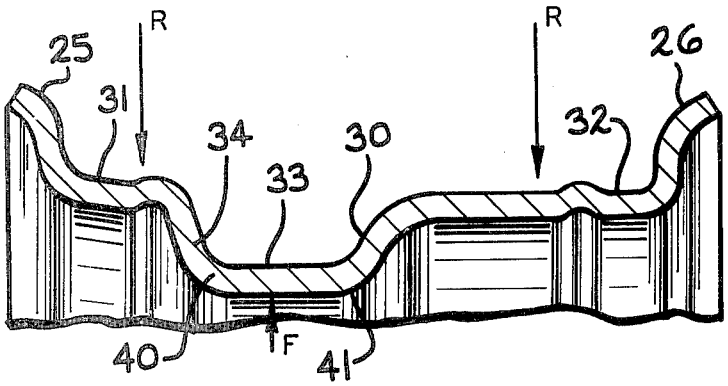
Figure 7:
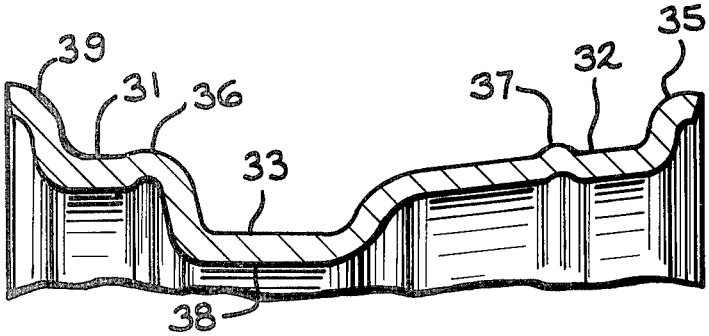

Blank 11 is first rolled into the shape of a hoop 13, shown in FIG. 2, and the opposing ends flash butt welded forming weld line 12. The thus formed band, shown in FIG. 2, is subsequently passed through multiple forming operations resulting in a finished wheel rim 24 illustrated in FIG. 3. FIGS. 4 through 7 progressively illustrate the band cross-sectional profiles resulting from each of four sequenced forming operations. The profile of FIG. 4 is preferably obtained by a press operation while the profiles of FIGS. 5 through 7 are obtained by roll forming operations.

The first forming operation comprises preforming the rim flange area by flaring the band lateral edges 25 and 26 radially outward as shown in FIG. 4. Preferably the edge flaring operation is performed in a press wherein the band may also be rounded out to a more true cylindrical configuration. For a 15 inch by 6 inch wheel rim, I have found it desirable to flare the edge periphery radially outward approximately nine and one-half (9½) percent larger than the circumference of hoop 13. Because of the low ductility of the material, flaring the band edges significantly further will overstress the butt weld resulting in weld fractures. Therefore, the amount of edge flaring is limited by the butt weld strength properties. Thus the ductility of the particular material being used largely determines the initial band dimensions.

Once flared, the band is placed on a forming roll for the first roll forming operation. This first roll forming operation is believed critical to the success of subsequent roll forming operations and the ultimate success in roll forming of an aluminum wheel rim.

In the first roll forming operation, a well portion, indicated generally by reference numeral 27 in FIG. 5, is formed by progressively rolling the material within this region to assume a diameter less than that of the band 13. Again by way of example for a 15×6″ aluminum wheel rim I have found it desirable to roll the well portion into the band to the extent that the well inside diameter $D_5$ is approximately 11.8% less than the original band diameter $D_4$. Since the initial band circumference is 9½% greater than that used in manufacturing a steel rim of comparable size (15×6″) the depth of the well is approximately 35 percent deeper than that otherwise rolled into a steel band during this first roll forming operation. Upon rolling the deep well into the band the well area is further work hardened by continued rolling of the well area between the forming pressure rolls. This deeper, work hardened wall is believed essential so that shrinking the tire seats and safety bead areas may be accomplished in the second roll forming operation. Quantitatively the exact amount of work hardening required is not presently known; it must be qualitatively determined by experimentation taking into consideration such parameters as material ductility, weldability, and strain hardening properties plus initial band circumference, thickness, and the width and depth of the well.

During roll forming of the well portion 27, the diameter of the adjacent rim, bead seats indicated by reference numerals 28 and 29, may be expected to increase. The amount of such increase being related to the well 27 depth. In roll forming an aluminum rim of the 15×6″ size, this increase is approximately 3.2%.

The second roll forming operation results in a band cross-sectional profile substantially as illustrated in FIG. 6. During this rolling operation band-roll contact is made and forces applied to effect flattening of the well portion into a flattened configuration 33 and circumferentially shrink or draw forming the bead seat and safety hump areas radially inward. Roll pressure is applied radially outward upon the inside diameter of the work hardened well 27 as indicated by force vector F as shown in FIG. 6. A resulting reaction pressure, indicated by force vectors R, is applied over the bead seat and safety hump surface areas. Deep well 27 is thusly forced radially outward ultimately assuming the well profile shown in FIG. 6. Since the well 27 material exhibits greater strength, because of prior work hardening, reactive forces R radially urge bead seat areas 31 and 32 radially inward effecting circumferential shrinkage through material compression. As the rolling operation progresses and the bead seat areas shrink, an equilibrium of internal material stresses develops to the extent that the deep well side walls 23 and 24 subsequently collapse to form side walls 30 and 34 and the flattened bottom 33. Upon collapse of deep well walls 23 and 24 a general increase of material thickness is achieved in the well radii areas indicated by reference numerals 40 and 41. Further material thickness increases are achieved in the bead seat and safety hump areas 31 and 32 because of material compression. The flanges 25 and 26 remain but are altered somewhat in configuration as a comparison between fingers 5 and 6 will readily reveal.

During the second roll forming operation as performed in the manufacture of a 15×6″ aluminum rim the well 33 circumference is increased approximately 2.6% over that of well 27 as formed in the first roll forming operation. However, the bead seat areas 31 and 32 are reduced in circumference by approximately 1.58% from that of areas 28 and 29.

The final roll forming operation results in the rim profile as shown in FIG. 4 wherein the flanges, which previously existed at the edges of the rim, are rolled over into their final flange configuration 39 and 35. Final sizing of the bead seats 31 and 32 and final formation of the safety humps 36 and 37 is also done during this roll forming operation. At the same time, the well portion 33 is finished to correct form.

At the completion of the rolling operation, the rim is expanded slightly to an oversize outside diameter and the inside diameter at the well, indicated by the reference numeral 38 in FIG. 7, is sized to be slightly smaller than the disk or center of the wheel which will then be assembled to complete the finished wheel.

It should be readily apparent that the described method reduces stretching and thinning of the metal during the rim forming operation as well as, by the expedient of work hardening, confining metal movement during the rolling operations to the areas desired. Thus, an improved rim with increased thickness at the well and bead seat corners results using relatively conventional forming techniques and apparatus which is used for forming conventional steel rims. This new method of rim forming performs equally as well with (HSLA) high strength low alloy steels and mild materials.

Once understanding the theory and method described above for roll forming of an aluminum rim one skilled in the art of steel wheel manufacture may apply the principles to roll forming aluminum rims of most any other size by qualitatively determining the initial band dimensions and initial well depth necessary to successfully form such a wheel rim.

Although the above description teaches forming the material band or hoop by coiling and welding the abutting free widthwise ends it is equally suitable to form wheel rims employing the teachings of my invention using circumferentially endless bands of material such as may be formed by extrusion or spinning techniques.

While the above description constitutes the preferred embodiment of my invention, it will be appreciated that the invention is susceptible to modification, variation and change without departing from the proper scope or fair meaning of the accompanying claims.

I claim:

1. A method of making a wheel rim comprising the steps of:
   (a) providing a cylindrical band of material,
   (b) deforming a portion of said band material between the lateral edges thereof, radially inward forming a circumferential well depression and imparting a first amount of strain hardening to said well material by such deformation,
   (c) squeezing said circumferential well depression between a pair of matched dies thereby coining the well material and further strain hardening said material within said circumferential well depression,
   (d) reshaping the well bottom and effecting shrinking of the bead seat areas through coaction of the strain hardened well material and the bead seat area material by forcing said well radially outward while radially restricting the band material on opposite sides of the well.

2. A method of forming a wheel rim comprising the steps of:
   (a) providing a rectangular blank of material,
   (b) butt welding the opposite widthwise ends thereof to form a cylindrical band,
   (c) deforming a portion of said band material, between the lateral edges thereof, radially inward forming a circumferential well depression thereby imparting a first amount of work hardening to said well depression material,
   (d) coining said well material to cause additional work hardening thereof,
   (e) forcing the band material on opposite sides of said well depression into respective bead seat configurations and simultaneously reshaping the well bottom so as to effect draw forming of the bead seat areas through coaction of the work hardened well material and the bead seat area material.

3. A method of manufacturing a wheel rim comprising the steps of:
   (a) providing a blank of stock material,
   (b) coiling said blank and joining the ends thereof to form a band,
   (c) forming a circumferential well between the lateral edges of said band by compressing a portion of the band material radially inward whereby said portion is work hardened a first amount,
   (d) further work hardening the material within said circumferential well by squeezing said well material between a pair of matched dies thereby coining said well material and increasing the strength and lowering the ductility of the circumferential well material, said work hardening being of sufficient magnitude to promote subsequent forming operations,
   (e) reshaping the work hardened well and forming the band material on opposite sides thereof into respective bead seat areas, whereby said work hardened well material cooperates to effect draw forming of said bead seat areas,
   (f) shaping and sizing the resulting wheel rim to its final desired size and configuration.

4. The method of manufacturing a wheel rim as claimed in claim 3 wherein steps (c) through (e) are performed by roll forming.

5. The method of manufacturing a wheel rim as claimed in claim 3 wherein the ends of said blank are buttwelded one to the other to form said band.

6. The method of manufacturing a wheel rim as claimed in claim 3 wherein the well is work hardened by coining the well material between at least two roll dies.

7. A method of manufacturing a wheel rim comprising the steps of:
   (a) cutting a rectangular blank of stock material to desired dimensions,
   (b) coiling said blank in the lengthwise direction,
   (c) welding the free ends of the coiled blank forming a substantially cylindrical band,
   (d) flaring the lateral edges of said band radially outward,
   (e) forming a circumferential well between the lateral edges of said band by rotating the band about its cylindrical axis and progressively forcing a portion of said band material radially inward toward said axis and between opposing matched roll dies filling the gap therebetween and imparting a first amount of work hardening to said well material,
   (f) coining the well material between said roll dies by continued rolling therebetween to further work harden said material such that said well material is characterized by having higher strength and lower ductility than the remaining band material,
   (g) reshaping the well and forming the respective bead seat areas by forcing said well radially outward while radially restricting the band material on opposite lateral sides of the well thereby flattening the well bottom and effecting draw forming of the bead seat areas radially inward through coaction of the work hardened well material and the bead seat area material,
   (h) shaping and sizing the resulting wheel rim to its final desired size and configuration.

8. In the method of roll forming a vehicle wheel rim wherein a cylindrical band of material is first operated upon to form a circumferential well portion, having a first amount of work hardening inherently induced by the formation of said well, spaced between the lateral sides thereof and subsequently operated upon to form the bead seat areas on either side of said well portion, the improvement comprising, coining said circumferential well portion to further work harden said material such that said well material is characterized by having greater strength and lower ductility than the remaining band material.

* * * * *